US005489973A

United States Patent [19]

Asano et al.

[11] Patent Number: 5,489,973

[45] Date of Patent: Feb. 6, 1996

[54] AN ELECTRICALLY CONDUCTIVE MEMBER OF AN IMAGE FORMING APPARATUS CONTAINING AN IMPURITY ATOM

[75] Inventors: Masaki Asano, Amagasaki; Noriko Yoshida, Itami; Shuji Iino, Hirakata; Akihito Ikegawa, Sakai; Izumi Osawa, Ikeda; Kenzo Tanaka, Ikoma, all of Japan

[73] Assignee: Minolta Camera Kabushiki Kaisha, Osaka, Japan

[21] Appl. No.: 995,682

[22] Filed: Dec. 23, 1992

[30] Foreign Application Priority Data

Dec. 25, 1991 [JP] Japan ..... 3-343264

[51] Int. Cl.[6] ..... G03G 15/02

[52] U.S. Cl. ..... 355/219; 361/225; 430/902

[58] Field of Search ..... 355/219, 272, 355/274, 221; 492/56; 361/225, 221, 220; 430/31, 902; 428/375, 381, 389

[56] References Cited

U.S. PATENT DOCUMENTS

| | | | |
|---|---|---|---|
| 3,959,574 | 5/1976 | Seanor et al. | 492/56 |
| 4,729,925 | 3/1988 | Chen et al. | 430/31 |
| 5,011,739 | 4/1991 | Nielsen et al. | 355/274 |
| 5,089,851 | 2/1992 | Tanaka et al. | 355/219 |
| 5,225,878 | 7/1993 | Asano et al. | 355/219 |

FOREIGN PATENT DOCUMENTS

| | | | |
|---|---|---|---|
| 0385462 | 9/1990 | European Pat. Off. | 355/219 |
| 55-29837 | 3/1980 | Japan . | |
| 59-224871 | 12/1984 | Japan . | |
| 3-038664 | 2/1991 | Japan | 355/219 |
| 3-101766 | 4/1991 | Japan | 355/219 |
| 3-293682 | 12/1991 | Japan | 355/219 |
| 4-077762 | 3/1992 | Japan | 355/219 |
| 4-119374 | 4/1992 | Japan | 355/219 |
| 4-311972 | 11/1992 | Japan | 355/219 |
| 5-107874 | 4/1993 | Japan | 355/219 |
| 5-173399 | 7/1993 | Japan | 355/219 |

*Primary Examiner*—A. T. Grimley
*Assistant Examiner*—Shuk Y. Lee
*Attorney, Agent, or Firm*—Burns, Doane, Swecker & Mathis

[57] ABSTRACT

An image forming apparatus provided with a contact charging device, in which an electrically conductive member contacts a surface of an electrostatic latent image carrier for charging the surface, wherein at least impurity atom selected from the group consisting of elements of Group IA, II, VI and VII of the periodic table is adhered to the electrically conductive member, and a total content of the impurity atom is in a range from 0.05 wt % to 0.45 wt % with respect to all atoms including the impurity atom and atoms forming the electrically conductive member.

16 Claims, 3 Drawing Sheets

AN ELECTRICALLY CONDUCTIVE MEMBER OF AN IMAGE FORMING APPARATUS CONTAINING AN IMPURITY ATOM

BACKGROUND OF THE INVENTION

1. Field of the Invention

The present invention relates to an image forming apparatus such as a copying machine and a printer provided with a contact charging device for charging a surface of an electrostatic latent image carrier.

2. Description of the Related Art

There has been proposed a contact charging system, in which a charging brush, a charging roller or other member such as an endless belt driven to rotate is brought into contact with a surface of an electrostatic latent image carrier for charging the same.

FIG. 3 is a schematic diagram showing widths of variation of a chargeable capacity, which is caused due to variation of environmental conditions when a surface of an electrostatic latent image carrier is charged by the contact charging system. In the figure, "HH" indicates a high-temperature and high-humidity environment, "NN" indicates a normal temperature and normal humidity environment, and "LL" indicates a low-temperature and low-humidity environment. As shown in FIG. 3, the charging operation by the contact charging system is significantly affected by the variation of environmental conditions such as temperature and humidity. The chargeable capacity of the charging device significantly changes from an initial value achieved at an initial use of the charging device, when a series of operations are repeated for forming images. Particularly in the contact charging system, therefore, the above two factors cause significant variation from LL1 to HH3 (variation width X in FIG. 3) when the chargeable capacity changes from an initial value (b) to a value (a) due to copying or printing operations.

The inventors have made various studies for solving the above problem, and found that the chargeable capacity significantly varies from the initial value and will be finally stabilized within a certain width a in accordance with repetition of a series of operations for forming the images, even if the initial chargeable capacity is excessively low (b) or excessively high (c).

The reason for this can be considered as follows. Charging actions of the contact charging system can be classified into actions by discharging operation, injection charging and frictional charging. The injection charging action among them is affected by the amount of powder or particles adhering to the electrically conductive contacting member for charging the image carrier, which have adhered onto the electrically conductive member with repetitive operations of the charging device. The powder or particles may be toner, charge controlling agent, and powder shaved from the electrostatic latent image carrier. The injection charging amount is determined by the amount of the powder or particles adhering to the electrically conductive member. Therefore, the chargeable capacity significantly changes due to the repetitive printing operations (including copying operations). However, the chargeable capacity is stable when the amount of said powder or particles adhering to the electrically conductive member becomes over a specific amount.

Therefore, the inventors have completed the invention based on the finding that, if the conductive member has born an amount of impurity, which maintains the chargeable capacity within a predetermined range, from an initial state, the chargeable capacity is stabilized throughout the printing operations.

SUMMARY OF THE INVENTION

An object of the invention is to provide an image forming apparatus provided with a contact charging device, in which variation of a chargeable capacity of the contact charging device, which may be caused by an environmental variation, is small, and a chargeable level can be stabilized within a substantially constant range, even after repetition of a series of operations for forming images.

The above object of the invention can be attained by providing an image forming apparatus provided with a contact charging device, in which an electrically conductive member contacts a surface of an electrostatic latent image carrier for charging the surface of the electrostatic latent image carrier, wherein the electrically conductive member has a portion, which contacts the surface of the electrostatic latent image carrier, at least one kind of impurity atoms selected from the group consisting of elements of Group IA, II, VI and VII of the periodic table is adhered to the portion, and a total content of the impurity atoms is in a range from 0.05 wt % to 0.45 wt % with respect to all atoms including the impurity atom and atoms forming the electrically conductive member . A voltage is applied to the electrically conductive member.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
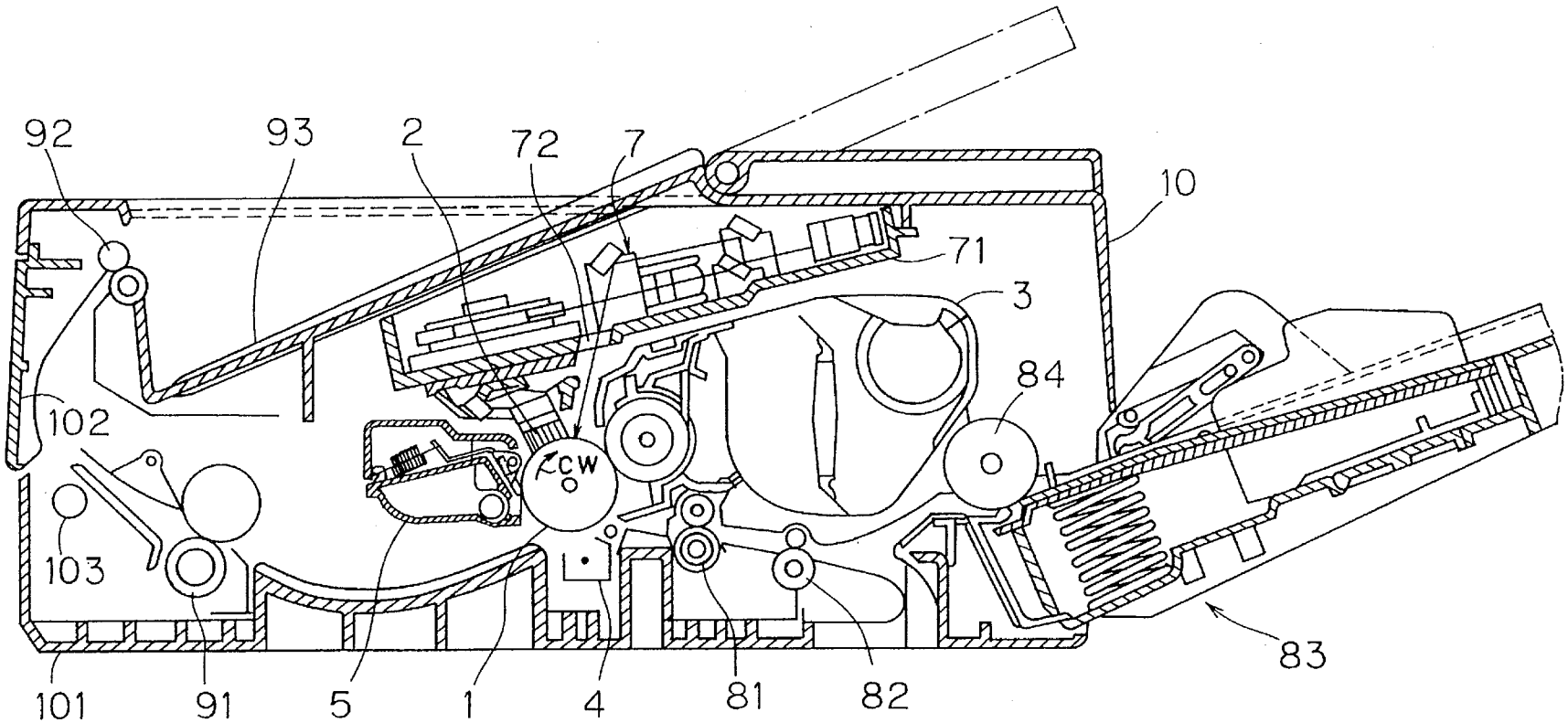
FIG. 1 is a schematic cross section of an image forming apparatus of an embodiment of the invention.

FIG. 1 is a schematic cross section of an image forming apparatus (printer) of an embodiment of the invention.

In FIG. 1, the printer is provided at its central portion with a photosensitive drum 1, i.e., electrostatic latent image carrier driven to rotate at a predetermined speed in a clockwise direction CW in the figure by an unillustrated driving device. Around the drum 1, there are sequentially disposed an electrically conductive contactor 2 of a charging device, a developing device 3, a transfer charger 4, and a cleaning device 5. In the illustrated embodiment, an electrically conductive brush hair portion is used as the conductive contactor 2.

Above the photosensitive drum 1, there is provided an optical system 7 including a housing 71 which accommodates a semiconductor laser generator, a polygon mirror, a toroidal lens, a half mirror, a spherical mirror, a return mirror, a reflection mirror and others. The housing 71 is provided at its floor with an exposure slit 72. The image exposure can be applied onto the photosensitive drum 1 through the exposure slit 72 and a space between the charger 2 and the developing device 3.

At the right side to the photosensitive drum 1 in the figure, there are sequentially disposed a timing roller pair 81, an intermediate roller pair 82 and a sheet feed cassette 83 to which a feed roller 84 is opposed. At the left side to the photosensitive drum 1 in the figure, there are sequentially disposed a fixing roller pair 91 and a sheet discharge roller 92, to which a sheet discharge tray 93 is opposed.

The parts and portions described above are mounted on a main body 10 of the printer. The main body 10 is formed of lower and upper units 101 and 102. The upper unit 102 carries the charging contactor 2, developing device 3, cleaning device 5, optical system 7, upper roller of the timing roller pair 81, upper roller of the intermediate roller pair 82, feed roller 84, upper roller of the fixing roller pair 91, discharge roller pair 92 and sheet discharge tray 93. The upper unit is pivotable around a shaft 103 disposed at the left end portion of the printer so that the end at the sheet feeding side of this unit may be upwardly opened for the restoration from the jamming state and various kinds of maintenance.

Figure 2A:
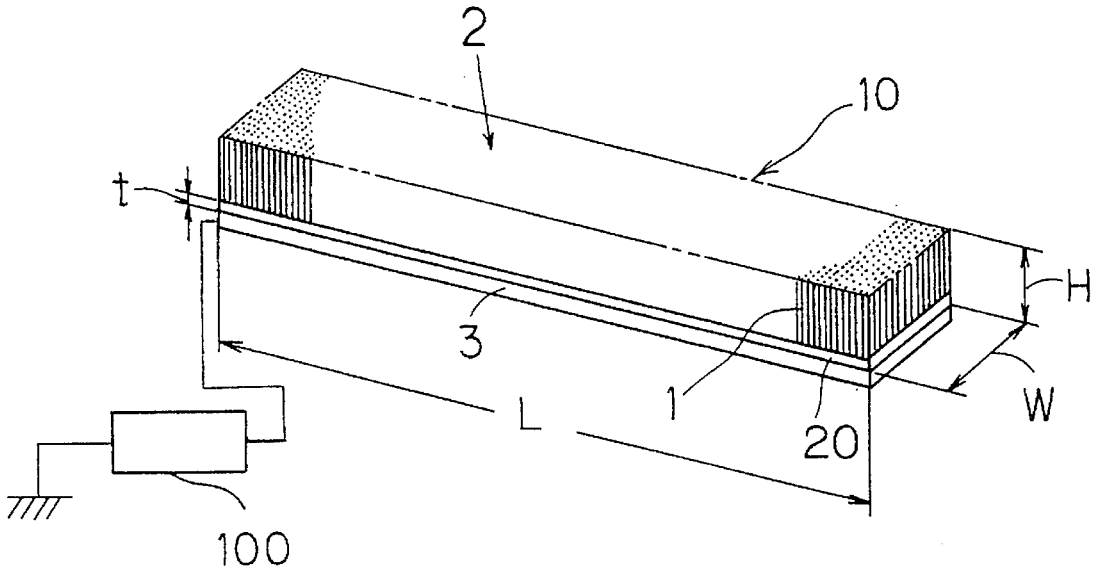
FIG. 2(A) is a perspective view showing a basic structure of a brush charging device which is used in the apparatus shown in FIG. 1.

FIG. 2(A) is a perspective view showing a basic structure of the brush charging device, which includes the electrically conductive member 2 formed of a conductive brush.

Figure 2B:
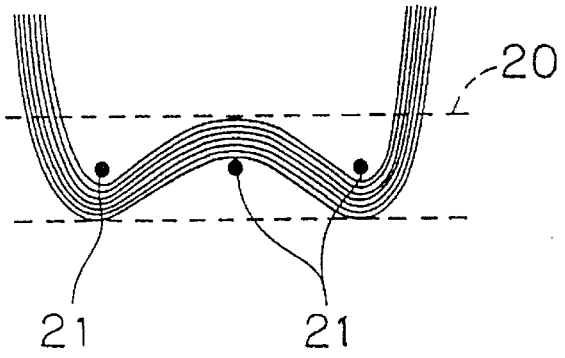
FIG. 2(B) is a schematic cross section for showing a structure of pile fabric having electrically conductive fibers woven therein of the device shown in FIG. 2(A)
Figure 3:
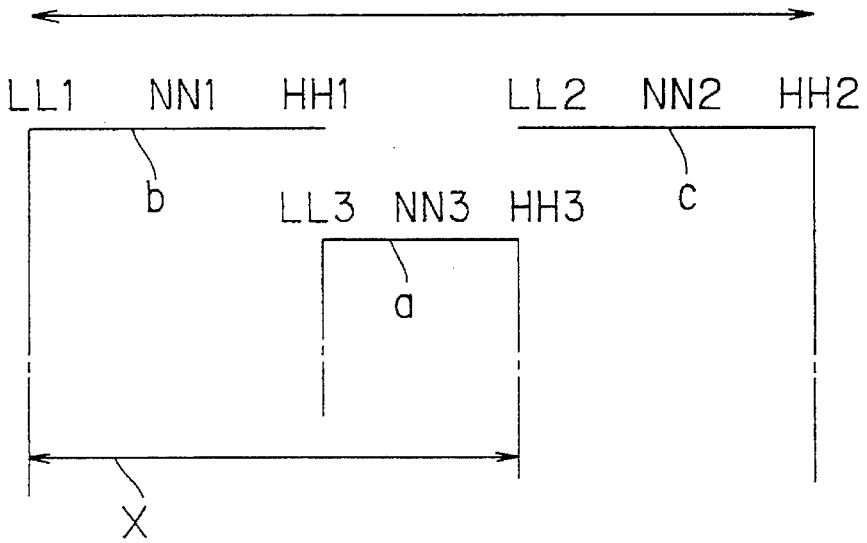
FIG. 3 shows widths of variation of a chargeable capacity due to environmental variation of a contact charging device.

The conductive brush 2 includes electrically conductive rayon fibers of 6 deniers. The rayon fiber 1 has an electrical resistivity of about $1\times10^5$ Ω.cm and contains conductive carbon powder at 18 wt % with respect to the whole weight. As shown in FIG. 2(B), bundles, each including 100 fibers, are woven in a W-form into warps 21 of a base cloth 20 having a thickness t of 1 mm to form pile fabric. The pile fabric is cut into a piece. The rear surface of this piece is coated with electrically conductive adhesive, by which the cut piece is fixed to a back plate 3 of aluminium, whereby the brush charging device of the fixed type is formed. A numeral 100 in FIG. 2 (A) indicates a power supply for applying a voltage to the conductive brush 2.

The conductive brush hair portion 10 and the base cloth 20 thus formed have a length L of 240 mm, width W of 7 mm and a height H of 5 mm.

The brush hair portion 10 of this conductive brush 2, to which a charging voltage is applied through the plate 3 by the power supply 100, contacts the surface of the photosensitive drum 1 to charge the surface of the drum 1.

Each brush hair (fiber) 1 forming the conductive brush 2 is manufactured as follows.

Wood pulp is immersed in solution of NaOH of a concentration between 18% and 19% at a temperature between 18° C. and 25° C. for one or two hours to obtain alkali cellulose, which is digested for reducing its degree of polymerization after squeezing and crushing. $CS_2$ is reacted on it at a temperature between 20° C. and 30° C. to form cellulose xanthate. This is solved into aqueous solution of dilute NaOH at a temperature between 10° C. and 18° C. to form viscose containing cellulose at about 8% and NaOH at about 6%, which is subjected to filtering, deaeration and ageing steps and then is sent to a spinning machine. Meanwhile, liquid which contains viscose and conductive carbon having a particle diameter of 0.1 μm is supplied to the spinning machine. Supply rates are adjusted to obtain mixture liquid at an intended carbon-cellulose rate in a tube of the spinning machine, and the mixture liquid is discharged through a nozzle into coagulating bath. The coagulating bath contains $H_2SO_4$ (8–10%), $ZnSO_4$ (1–2%) and $Na_2SO_4$ (20–30%). The fiber is formed by wet spinning at a temperature between 40° C. and 50° C., and then is rinsed and desulfurized, whereby the conductive rayon fiber is completed. The chemical formulas of the pulp and others are as follows.

Pulp (cellulose) $(C_6H_{10}O_5)_n$

Alkali cellulose $(C_6H_9O_4.ONa)_n$

Cellulose xanthate $(C_6H_9O_4.OCS_2Na)_n$

Rayon $(C_6H_{10}O_5)_n$

Impurity atoms selected from periodic table IA, II, VI and VII groups are adhered to the conductive rayon fiber thus formed.

The impurity atoms may be sulfur (S), calcium (Ca), chlorine (Cl), sodium (Na) and magnesium (Mg). Other atoms such as aluminium (Al), silicon (Si) and/or iron (Fe) may be additionally contained therein. If the total content of the impurity atoms were excessively large, the chargeable level of the electrostatic latent image carrier would become excessively large during the initial use of the charging device. If the total content of the impurity atoms were excessively small, the charge implanting effect would reduce, and thus the chargeable level would reduce. Therefore, the value between 0.05 wt % and 0.45 wt % is preferable.

In a typical example for adding the impurity atoms into the conductive rayon fiber, the rayon fiber is washed with liquid containing the impurity atoms.

The liquid for the above washing may be aqueous solution of, for example, NaOH, NaCl, $NaHCO_3$, $Na_2SO_4$, $Na_2S_2O_3$, $NaNO_3$, $Na_2S$, $Na_2CO_3$, $Na_2SiO_3$, $CaSO_4$, $Ca(OH)_2$, $CaCl_2$, $BaCl_2$, $MgCl_2$, $MgSO_4$, $ZnSO_4$, KOH, KCl, LiOH, LiCl, HBr, HCl, $HClO_3$, $HClO_4$, $H_2SO_4$, $NH_4Cl$, $FeCl_3$, $FeSO_4$, $AlCl_3$, $Al(NO_3)_3$, $AL_2(SO_4)_3$. By adjusting the concentration of the aqueous solution and the number of times of the washing operation, an intended amount of atoms can be contained in the rayon fiber.

Figure 4:
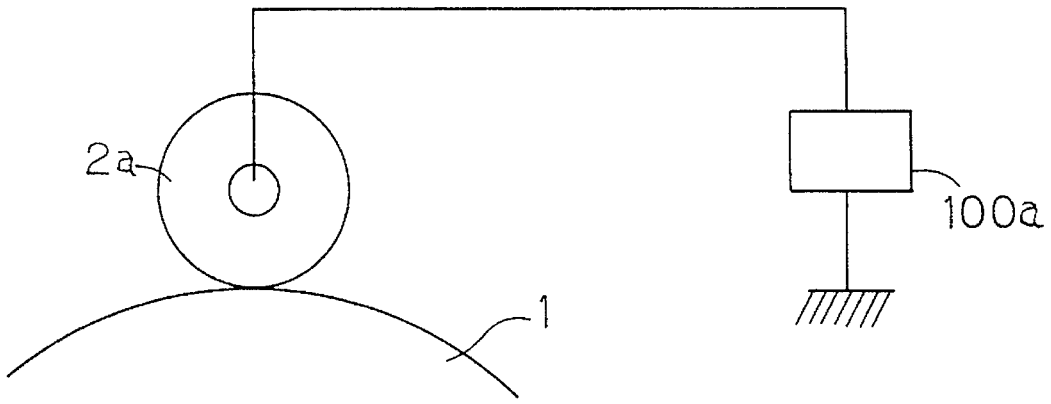
FIG. 4 shows another contact charging device which is used in an image forming apparatus.

The conductive member used in the image forming apparatus of the invention is not restricted to the brush form of the embodiment described above, and may be of a roller type as shown in FIG. 4. In FIG. 4, a numeral **100*a* indicates a power supply for applying a voltage to a contactor 2*a*** of a roller type. Further, it may be of other forms such as a blade and a belt. The forms can be selected in accordance with the specification and form of the image forming apparatus.

Whatever the form may be selected, the image forming apparatus, in which the variation of the chargeable capacity due to the environmental variation is suppressed throughout the printing operations and can be stabilized substantially in a constant range, is obtained by employing the conductive member, to which at least the impurity atom selected from the group consisting of elements of Group IA, II, VI and VII of the periodic table is adhered to obtain the total content of the impurity atom with respect to all atoms including the impurity atom, and atoms forming the electrically conductive member in the range from 0.05 wt % to 0.45 wt %.

The present invention is particularly effective for apparatuses in which an implanting charge effect is relative high, i.e., a relative speed between the the electrically conductive member and the surface of the electrostatic latent image carrier is of a relatively small, for example, of 100 mm/sec or less.

Experimental Example 1

The conductive rayon fiber obtained in the above described manner was immersed in washing water containing Ca, Cl and Na for washing the same.

The washed conductive rayon fiber was analyzed by an Auger Electron Spectroscopy (JAMP-10S manufactured by Nippon Densi Kabushiki Kaisha) and a Secondary Ion Mass Spectrometry (DIDA-3000 manufactured by ATOMIKA Corp.). The rayon fiber contained S, Ca, Cl and Na at the contents of 0.20, 0.10, 0.08 and 0.07 wt % with respect to the whole atoms including these impurity atoms and atoms forming the conductive rayon fiber, respectively, and at the total content of 0.45 wt %.

The charging brush shown in FIG. 2(A) was formed, using the conductive rayon fibers described above.

Experimental Examples 2 and 3

The conductive rayon fiber was washed in the manner similar to that in the experimental example 1, except for the number of washing operations and sizes of the washing bath. Thereby, the amount of deposit or inclusion was adjusted to obtain two kinds of rayon fibers. The rayon fibers were analyzed in the same manner as the experimental example 1, and the following result was obtained. One kind of rayon fiber contained S, Ca, Cl and Na at the contents of 0.10, 0.06, 0.03 and 0.01 wt %, respectively, and at the total content of 0.20 wt %. The other kind of rayon fiber contained S, Ca, Cl and Na at the contents of 0.025, 0.01, 0.01 and 0.005 wt %, respectively, and at the total content of 0.05 wt %.

The charging brush shown in FIG. 2(A) was formed, using each kind of the conductive rayon fibers described above.

Experimental Example 4

The conductive rayon fiber was washed and analyzed in the manner similar to that in the experimental example 1, except for that the washing water contained Ca and Cl.

The rayon fiber contained S, Ca and Cl at the contents of 0.10, 0.06 and 0.04 wt % with respect to the whole atoms including these impurity atoms and atoms forming the conductive rayon fiber, respectively, and at the total content of 0.20 wt %.

The charging brush shown in FIG. 2(A) was formed, using the conductive rayon fibers described above.

Experimental Example 5

The conductive rayon fiber was immersed into the washing water containing Na and Ca for washing the same.

The washed conductive rayon fiber was analyzed in the same manner as the experimental example 1. The rayon fiber contained S, Ca and Na at the contents of 0.01, 0.18 and 0.02 wt % with respect to the whole atoms including these impurity atoms and atoms forming the conductive rayon fiber, respectively, and at the total content of 0.21 wt %.

Experimental Example 6

The conductive rayon fiber was immersed into the washing water containing Ca and Cl and was sufficiently washed.

The washed conductive rayon fiber was analyzed in the same manner as the experimental example 1. The rayon fiber contained Ca and Cl at the contents of 0.15 and 0.05 wt % with respect to the whole atoms including these impurity atoms and atoms forming the conductive rayon fiber, respectively, and at the total content of 0.20 wt %.

Experimental Example 7

The conductive rayon fiber was washed and analyzed in the manner similar to that in the experimental example 1, except for that the washing water is pure water.

The rayon fiber contained only S as the impurity at the content of 0.20 wt % with respect to the whole atoms including this impurity and atoms forming the conductive rayon fiber.

Experimental Comparison Examples 1 and 2

The conductive rayon fiber was washed in the manner similar to that in the experimental example 1, except for the number of washing operations and sizes of the washing bath. Thereby, the amount of deposit or inclusion was adjusted to obtain two kinds of rayon fibers. The rayon fibers were analyzed in the same manner as the experimental example 1, and the following result was obtained. One kind of rayon fiber contained S, Ca, Cl and Na at the contents of 1.30, 0.10, 0.08 and 0.02 wt %, respectively, and at the total content of 1.50 wt %. The other kind of rayon fiber contained S, Ca, Cl and Si at the contents of 0.01, 0.01, 0.01 and 0.01 wt %, respectively, and at the total content of 0.04 wt %. The charging brush shown in FIG. 2(A) was formed, using each kind of the conductive rayon fibers described above.

Experimental Comparison Examples 3 and 4

The conductive rayon fiber was washed in the manner similar to that in the experimental example 4, except for the number of washing operations and sizes of the washing bath. Thereby, the amount of deposit and/or inclusion were adjusted to obtain two kinds of rayon fibers. One kind of rayon fiber contained S, Ca and Cl at the contents of 0.30, 0.15, and 0.10 wt %, respectively, and at the total content of 0.55 wt %. The other kind of rayon fiber contained S, Ca and Cl at the contents of 0.02, 0.01 and 0.01 wt %, respectively, and at the total content of 0.04 wt %. The charging brush shown in FIG. 2(A) was formed, using each kind of the conductive rayon fibers described above.

Experimental Comparison Example 5

The conductive rayon fiber was sufficiently washed and analyzed in the manner similar to that in the experimental example 6, except for the number of washing operations and sizes of the washing bath.

The rayon fiber contained Ca and Cl at the contents of 0.30 and 0.25 wt %, respectively, and at the total content of 0.55 wt %. The charging brush shown in FIG. 2(A) was formed, using the conductive rayon fibers described above.

Experimental Comparison Example 6

The conductive rayon fiber was washed and analyzed in the manner similar to that in the experimental example 7, except for the number of washing operations and sizes of the washing bath.

The rayon fiber contained only S as the impurity atom at the content of 0.04 wt %. The charging brush shown in FIG. 2(A) was formed, using the conductive rayon fibers described above.

Experimental Comparison Example 7

The conductive rayon fiber was washed and analyzed in the manner similar to that in the experimental example 7, except for the number of washing operations and sizes of the washing bath, whereby the rayon fiber contained the impurity atoms, which do not form the rayon fiber itself, at the content less than 0.001 wt % with respect to the whole atoms including the impurity atoms and atoms forming the conductive rayon fiber. The charging brush shown in FIG. 2(A) was formed, using the conductive rayon fibers described above.

The printer shown in FIG. 1, in which each of the charging brushes of the experimental examples 1–7 and experimental comparison examples 1–7 was assembled, was driven at a peripheral speed of 35 mm/sec of the photosensitive drum 1 while applying a voltage of −1.2 KV to the charging brush for uniformly charging the surface of the photosensitive drum 1 at −800 V. Surface potential of the photosensitive drum 1 was measured under the environmental conditions of 10° C. and 15% RH (LL), 20° C. and 50% RH (NN), and 30° C. and 85% RH (HH).

As can be seen from the following table 1, if the rayon fiber contained at least one kind of atoms S, Ca, Cl and Na at the total content between 0.05 wt % and 0.45 wt %, the maximum variation value from the initial printing to the completion of printing of 5000 sheets is less than 200 V, and thus good characteristics were obtained after the repetition of printing. The above value of 200 V is still larger than the maximum value among differences obtained from the columns showing the initial charged potentials and the charged potentials after the printing of 5000 sheets in the table 1 and table 2, which will be described later. In the tables, the cells containing oblique line mean that the noise level less than 0.001 wt % was obtained by quantitative measurement, and thus mean that the atoms in question can be regarded not to be contained.

At the column "EV. (Evaluation)" in the tables 1 and 2, "○" and "X" indicates "Good" and "Unacceptable, respectively.

Experimental Example 8

The charging brush used in the experimental example 1was assembled in the printer shown in FIG. 1. The printer was driven at the peripheral speed 80 mm/sec of the photosensitive drum 1, and the surface potential of the drum 1 was measured under the environmental conditions of 10° C. and 15% RH (LL), 20° C. and 50% RH (NN), and 30° C. and 85% RH (HH). The result is shown in the Table 2.

Experimental Examples 9, 10 and 11

Each of the charging brushes of the experimental examples 2, 3 and 6 was assembled in the printer used in the experimental example 8, and the surface potential of the photosensitive drum 1 was measured in the similar manner. The result is shown in the Table 2.

Experimental Comparison Examples 8, 9, 10 and 11

Each of the charging brushes of the experimental comparison examples 1, 2, 5 and 7 was assembled in the printer used in the experimental example 8, and the surface potential of the photosensitive drum 1 was measured in the similar manner. The result is shown in the Table 2.

TABLE 1

| | Content of Impurity (wt %) | | | | | Int. Pt. (V) | | | 5000 Prts. (V) | | | EV. | |
|---|---|---|---|---|---|---|---|---|---|---|---|---|---|
| | S | Ca | Cl | Na | total | LL | NN | HH | LL | NN | HH | VR. | EV. |
| Ex. 1 | 0.20 | 0.10 | 0.08 | 0.07 | 0.45 | −790 | −850 | −960 | −770 | −820 | −930 | 190 | ○ |
| Ex. 2 | 0.10 | 0.06 | 0.03 | 0.01 | 0.20 | −750 | −800 | −900 | −750 | −800 | −910 | 160 | ○ |
| Ex. 3 | 0.025 | 0.01 | 0.01 | 0.005 | 0.05 | −700 | −760 | −840 | −740 | −780 | −890 | 190 | ○ |
| Ex. 4 | 0.10 | 0.06 | 0.04 | | 0.20 | −750 | −800 | −900 | −750 | −800 | −910 | 160 | ○ |
| Ex. 5 | 0.01 | 0.18 | | 0.02 | 0.21 | −740 | −800 | −900 | −750 | −800 | −910 | 170 | ○ |
| Ex. 6 | | 0.15 | 0.05 | | 0.20 | −770 | −820 | −930 | −760 | −810 | −920 | 170 | ○ |
| Ex. 7 | 0.20 | | | | 0.20 | −770 | −820 | −940 | −760 | −810 | −930 | 180 | ○ |
| Cp. 1 | 1.30 | 0.10 | 0.08 | 0.02 | 1.50 | −850 | −930 | −1060 | −770 | −830 | −940 | 290 | X |
| Cp. 2 | 0.01 | 0.01 | 0.01 | 0.01 | 0.04 | −650 | −710 | −790 | −740 | −770 | −890 | 240 | X |
| Cp. 3 | 0.30 | 0.15 | 0.10 | | 0.55 | −830 | −900 | −1000 | −770 | −820 | −940 | 230 | X |
| Cp. 4 | 0.02 | 0.01 | 0.01 | | 0.04 | −650 | −700 | −780 | −740 | −770 | −880 | 230 | X |
| Cp. 5 | | 0.30 | 0.25 | | 0.55 | −850 | −910 | −1020 | −770 | −820 | −930 | 250 | X |
| Cp. 6 | 0.04 | | | | 0.04 | −600 | −680 | −750 | −720 | −740 | −860 | 260 | X |
| Cp. 7 | | | | | | −540 | −640 | −740 | −700 | −740 | −860 | 320 | X |

Int. Pt.: Initial Chargeable Potential
5000 Pts.: Chargeable Potential After Printing of 5000 Sheets
EV. VR.: Environmental Variation
EV.: Evaluation
EX.: Experimental Example
CP.: Comparison Example

TABLE 2

| | Content of Impurity (wt %) | | | | | Int. Pt. (V) | | | 5000 Prts. (V) | | | EV. | |
|---|---|---|---|---|---|---|---|---|---|---|---|---|---|
| | S | Ca | Cl | Na | total | LL | NN | HH | LL | NN | HH | VR. | EV. |
| Ex. 8 | 0.20 | 0.10 | 0.08 | 0.07 | 0.45 | −780 | −850 | −950 | −760 | −820 | −910 | 190 | ○ |
| Ex. 9 | 0.10 | 0.06 | 0.03 | 0.01 | 0.20 | −740 | −790 | −900 | −740 | −790 | −910 | 170 | ○ |
| Ex. 10 | 0.025 | 0.01 | 0.01 | 0.005 | 0.05 | −690 | −760 | −840 | −730 | −780 | −870 | 180 | ○ |
| Ex. 11 | | 0.15 | 0.05 | | 0.20 | −750 | −810 | −720 | −750 | −800 | −900 | 180 | ○ |
| Cp. 8 | 1.30 | 0.10 | 0.08 | 0.02 | 1.50 | −860 | −930 | −1040 | −770 | −820 | −930 | 270 | X |
| Cp. 9 | 0.01 | 0.01 | 0.01 | 0.01 | 0.04 | −650 | −700 | −770 | −720 | −750 | −880 | 230 | X |
| Cp. 10 | | 0.30 | 0.25 | | 0.55 | −850 | −900 | −1000 | −780 | −810 | −910 | 220 | X |
| Cp. 11 | | | | | | −540 | −630 | −720 | −700 | −730 | −840 | 300 | X |

Int. Pt.: Initial Chargeable Potential
5000 Pts.: Chargeable Potential After Printing of 5000 Sheets
EV. VR.: Environmental Variation
EV.: Evaluation
EX.: Experimental Example
CP.: Comparison Example The photosensitive drum 1 is a negatively chargeable photosensitive member of a function-separated type which has the sensitivity to the long wave light, and is manufactured as follows.

Photosensitive liquid is formed of τ-type non-metal phthalocyanine at 1 weight part, polyvinyl butyral resin (degree of acetylation of 3 mol % or less, a butylated value of 70 mol %, polymerization degree of 1000) at 2 weight parts and tetrahydrofuran at 100 weight parts. This liquid is kept in a ball mill pot for 24 hours to be dispersed. The photosensitive liquid thus manufactured is applied to a base member, i.e., a cylindrical aluminium member having a diameter of 30 mm and a length of 240 mm by a dipping method, and then is dried to form a charge generating layer of 0.4 μm in thickness.

Then, liquid, which contains hydrazone compound having a following structural formula, is used.

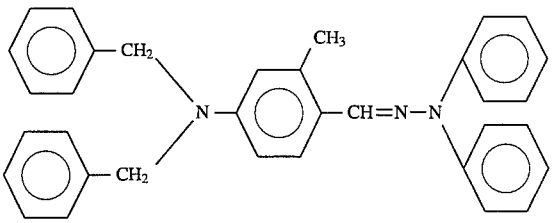

This liquid includes the above hydrazone compound at 8 weight parts, as well as orange pigment (Sumiplast Orange 12 manufactured by Sumitomo Kagaku Kabushiki Kaisha) at 0.1 weight part, and polycarbonate resin (Panlite L-1250 manufactured by Teijin Kasei Kabushiki Kaisha) at 10 weight parts which are dissolved into solvent of tetrahydrofuran at 180 weight parts. This liquid is applied to the charge generating layer by the dipping method, and then is dried to form a charge transmitting layer of 18 μm in thickness. In this manner, the photosensitive drum 1 is manufactured.

The τ-metal free phthalocyanine exhibits strong peaks at Bragg angles (2θ±0.2 deg.) of 7.6, 9.2, 16.8, 17.4, 20.4 and 20.9, in the X-ray diffraction pattern obtained with $CuK\alpha_1$/Ni X-ray having a wave length of 1.541Å. In particular, the infrared ray absorption spectrum thereof has four absorption bands, of which the strongest value is 751±2 $cm^{-1}$, between 700 $cm^{-1}$ and 760 $cm^{-1}$, two absorption bands of a substantially equal strength between 1320 $cm^{-1}$ and 1340 $cm^{-1}$, and a characteristic absorption band at 3288±3 $cm^{-1}$.

The electrostatic latent image carrier to which the charging device of the invention can be applied is not restricted to that described above.

In an image forming system using a long wave light source such as a laser optical system and an LED array, there is used the photosensitive member having the sensitivity to the long wave as described above. In an image forming system which employs a liquid crystal shutter array, a PLZT shutter array or the like and utilizes visible light as the light source, there is used the photosensitive member having the sensitivity to the relative visible range. Also in the visible light image forming system provided with lens and mirror optical system which are used in an ordinary analog PPC, there is used the photosensitive member having the sensitivity to the relative visible range.

There is no restriction with respect to the material of the image carrier. In addition to the organic photosensitive member of the function-separated type described before, a photosensitive member of a single layer structure may be used. various known material other than those described before may be used for the charge generating material, charge transmitting material, binder resin and others. Also, inorganic material such as zinc oxide, cadmium sulfide, selenium alloy and amolphous silicon may be used.

A surface protective layer may be formed on the outermost surface of the photosensitive member. This protective layer may be formed of resin such as ultraviolet setting resin, cold setting resin and thermosetting resin. It also may be formed of resin in which resistance adjusting agent is dispersed in the above resin. Further, it may be formed of a thin film which is prepared by vacuum deposition, ion plating or the like of metal oxide or metal sulfide. Moreover, it may be formed of amolphous carbon film which is formed by plasma-polymerization of gas containing hydrocarbon.

The base member also may be formed of various material having the electrical conductivity, and may be of a flat shape or a belt-like shape, depending on the imaging system.

If used light source emits coherent light, the base member may be roughened or blackened to prevent so-called interference pattern.

The toner used in the developing device 3 described before is of a negative chargeable type, and is formed from the following composition. The composition is formed of bisphenol A polyester resin at 100 weight parts, carbon black MA#8 (manufactured by Mitsubishi Kasei Kogyo Kabushiki Kaisha) at 5 weight parts, Bontron S-34 (manufactured by Orient Kagaku Kogyo Kabushiki Kaisha) at 3 weight parts, and Viscorl TS-200 (manufactured by Sanyo Kasei Kogyo Kabushiki Kaisha) at 2.5 weight parts. This composition is kneaded, ground and classified to manufacture toner particles having a mean diameter of 10 μm and a distribution, in which 80 weight percents are included in a range of the particle diameters from 7 μm to 13 μm. Hydrophobic silica (Tanolux 500 manufactured by Talco Co.) at 0.75 weight percents is added as fluidization agent to the toner particles, and mixed and agitated by a homogenizer.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus provided with a contact charging device, in which an electrically conductive member contacts a surface of an electrostatic latent image carrier for charging said surface, wherein an impurity comprising an atom selected from the group consisting of elements of Group IA, II, VI and VII of the Periodic Table is adhered to said electrically conductive member, and a total content of said impurity atom is in a range from 0.05 wt % to 0.45 wt % with respect to all atoms including the impurity atom and atoms forming the electrically conductive member.

2. An image forming apparatus according to claim 1, wherein said electrically conductive member is a roller.

3. An image forming apparatus according to claim 1, wherein said electrically conductive member is a brush.

4. An image forming apparatus according to claim 1, wherein a voltage is applied to said electrically conductive member.

5. An image forming apparatus provided with a contact charging device, in which an electrically conductive brush contacts a surface of an electrostatic latent image carrier for charging said surface, wherein brush hairs forming said electrically conductive brush are formed of electrically conductive rayon fibers, wherein an impurity comprising an atom selected from the group consisting of elements of Group IA, II, VI and VII of the Periodic Table is adhered to said rayon fiber, and a total content of said impurity atom is in a range from 0.05 wt % to 0.45 wt % with respect to all atoms including the impurity atom and atoms forming the electrically conductive brush.

6. An image forming apparatus according to claim 5, wherein said impurity atom is calcium.

7. An image forming apparatus according to claim 5, wherein said impurity atom is sodium.

8. An image forming apparatus according to claim 5, wherein said impurity atom is chlorine.

9. An image forming apparatus provided with a contact charging device, in which an electrically conductive member contacts a surface of an electrostatic latent image carrier and a voltage is applied to said electrically conductive member for charging said surface, wherein an impurity comprising an atom selected from the group consisting of elements of Group IA, II, VI and VII of the Periodic Table is adhered to said electrically conductive member, a total content of said impurity atom is in a range from 0 05wt % to 0 45 wt % with respect to all atoms including the impurity atom and atoms forming the electrically conductive member, and a speed of said surface of said electrostatic latent image carrier is 100 mm/sec or less.

10. An image forming apparatus according to claim 9, wherein said electrically conductive member is a roller.

11. An image forming apparatus according to claim 9, wherein said electrically conductive member is a brush.

12. An image forming apparatus according to claim 1, wherein said electrically conductive member is formed of rayon fibers.

13. A contact charging device for charging a surface of an electrostatic latent image carrier comprising an electrically conductive member, wherein an impurity comprising an atom selected from the group consisting of elements of Group IA, II, VI and VII of the Periodic Table is adhered to said electrically conductive member, a total content of said impurity atom is in a range from 0.05 wt % to 0.45 wt % with respect to all atoms including the impurity atom and atoms forming the electrically conductive member.

14. A contact charging device according to claim 13, wherein said electrically conductive member is a roller.

15. A contact charging device according to claim 13, wherein said electrically conductive member is a brush.

16. A contact charging device according to claim 15, wherein brush hairs forming said electrically conductive brush are formed of electrically conductive rayon fibers.

* * * * *